US007303067B2

(12) United States Patent
Herzog

(10) Patent No.: US 7,303,067 B2
(45) Date of Patent: Dec. 4, 2007

(54) DISPLAY STRUCTURE FOR GEMSTONES AND THE LIKE

(76) Inventor: Ralph Herzog, Noble Packaging, 5555 Casgrain, Suite 100, Montreal, Quebec (CA) H2T 1Y1

( * ) Notice: Subject to any disclaimer, the term of this patent is extended or adjusted under 35 U.S.C. 154(b) by 0 days.

(21) Appl. No.: 11/434,339

(22) Filed: May 15, 2006

(65) Prior Publication Data

US 2006/0201827 A1 Sep. 14, 2006

Related U.S. Application Data

(63) Continuation of application No. 10/771,732, filed on Feb. 4, 2004, now Pat. No. 7,055,681.

(51) Int. Cl.
*A45C 11/16* (2006.01)

(52) U.S. Cl. ..... 206/6.1; 206/566; 206/769

(58) Field of Classification Search ..... 63/26–32; 211/85.2; 451/389; 29/281.1, 281.5; 269/43, 269/45, 254; 206/6.1, 269, 565, 566
See application file for complete search history.

(56) References Cited

U.S. PATENT DOCUMENTS 1,114,998 A 10/1914 Love
1,125,253 A 1/1915 Barber
2,144,336 A 1/1939 Katz
D181,321 S 10/1957 Stowell
2,874,828 A 2/1959 Neugebauer
2,883,048 A 4/1959 Lentz
2,950,003 A 8/1960 Simmons et al.
3,410,634 A 11/1968 Buckner
3,762,544 A 10/1973 Matthews
D244,085 S 4/1977 Giddings et al.
D255,546 S 6/1980 Zaidmann et al.
4,320,831 A 3/1982 Szabo et al.
4,378,876 A 4/1983 Szabo et al.
4,595,095 A 6/1986 Lam et al.
5,239,354 A 8/1993 Russell
5,590,779 A 1/1997 Ramsey
6,324,869 B1 12/2001 Vanlioglu
6,584,804 B1 7/2003 Freedman et al.
2004/0195114 A1 10/2004 Lau

*Primary Examiner*—Mickey Yu
*Assistant Examiner*—Jerrold Johnson
(74) *Attorney, Agent, or Firm*—Dickstein, Shapiro, LLP.

(57) ABSTRACT

A display structure for an article. The display structure includes a base, a gripping member extending from the base and movable into a position for receipt and clasping of an article, and a platform member positioned above the base and coupled to the gripping member such that movement of the platform member moves the gripping member into the position for receipt and clasping of the article.

19 Claims, 7 Drawing Sheets

DISPLAY STRUCTURE FOR GEMSTONES AND THE LIKE

CROSS REFERENCE TO RELATED APPLICATIONS

This application is a continuation of application Ser. No. 10/771,732, filed Feb. 4, 2004 now U.S. Pat. No. 7,055,681.

BACKGROUND OF THE INVENTION

1. Field of the Invention

The present invention relates to a display structure for an article. More particularly, the present invention relates to a display structure for gemstones and the like.

2. Description of the Related Art

In the gem industry, for example, loose stones are commonly shown to potential buyers in shops for evaluation before purchase. During the evaluation, the potential buyer is often invited to examine the loose stone with a 10× magnification lens while the stone is clasped within a gemstone holder.

The gemstone holder typically consists of a spring-loaded instrument having a set of prongs which are extendable out of one side thereof for grasping of the stone. Once the loose stone is grasped in the gemstone holder, the potential buyer holds the gemstone holder in one hand and the magnification lens in the other, and inspects the stone. Alternatively, the potential seller may hold the gemstone holder containing the stone and allow the potential buyer to hold the magnification lens for examination of the loose stone.

Therefore, inspection and viewing of a loose stone typically requires both hands of a single person, or two separate persons each holding one of the gemstone holder or the magnification lens. Thus, there is a need for a display and viewing structure for gems and other valuable articles which allows the article to be inspected by the potential buyer without the need for use of both hands, or two separate persons.

Similar practices to those described above are employed by potential buyers of other small valuable articles, such as, coins, stamps, etc.

BRIEF SUMMARY OF THE INVENTION

Accordingly, the present invention provides a display structure that allows simple viewing and inspection of an article. In accordance with one preferred embodiment, the display structure of the present invention includes a base, a gripping member extending from the base and adapted to clasp an article, and a platform member positioned above the base and coupled to the gripping member. The base is preferably designed to stand on or be attached to a surface.

The platform member is coupled to the gripping member such that movement of the platform member relative to the base moves the gripping member into a position for receipt and clasping of the article. Movement of the platform member is preferably accomplished by the application of pressure to an upper surface of the platform member toward the base. When the article is positioned within the set of gripping prongs it is ready for display and viewing.

The display structure can be provided with a fabric or other pliable material extending between the base and the platform member so as to conceal the working components of the display structure and form an enclosure. Alternatively, the display structure can be placed within a display case having a cover with a portal for viewing the article therein.

BRIEF DESCRIPTION OF THE DRAWINGS

For the purpose of illustrating the invention, there is shown in the drawings a form which is presently preferred, it being understood, however, that the invention is not limited to the precise arrangements and instrumentalities shown. The features and advantages of the present invention will become apparent from the following description of the invention that refers to the accompanying drawings, in which.

DESCRIPTION OF PREFERRED EMBODIMENTS OF THE INVENTION

Figure 1:
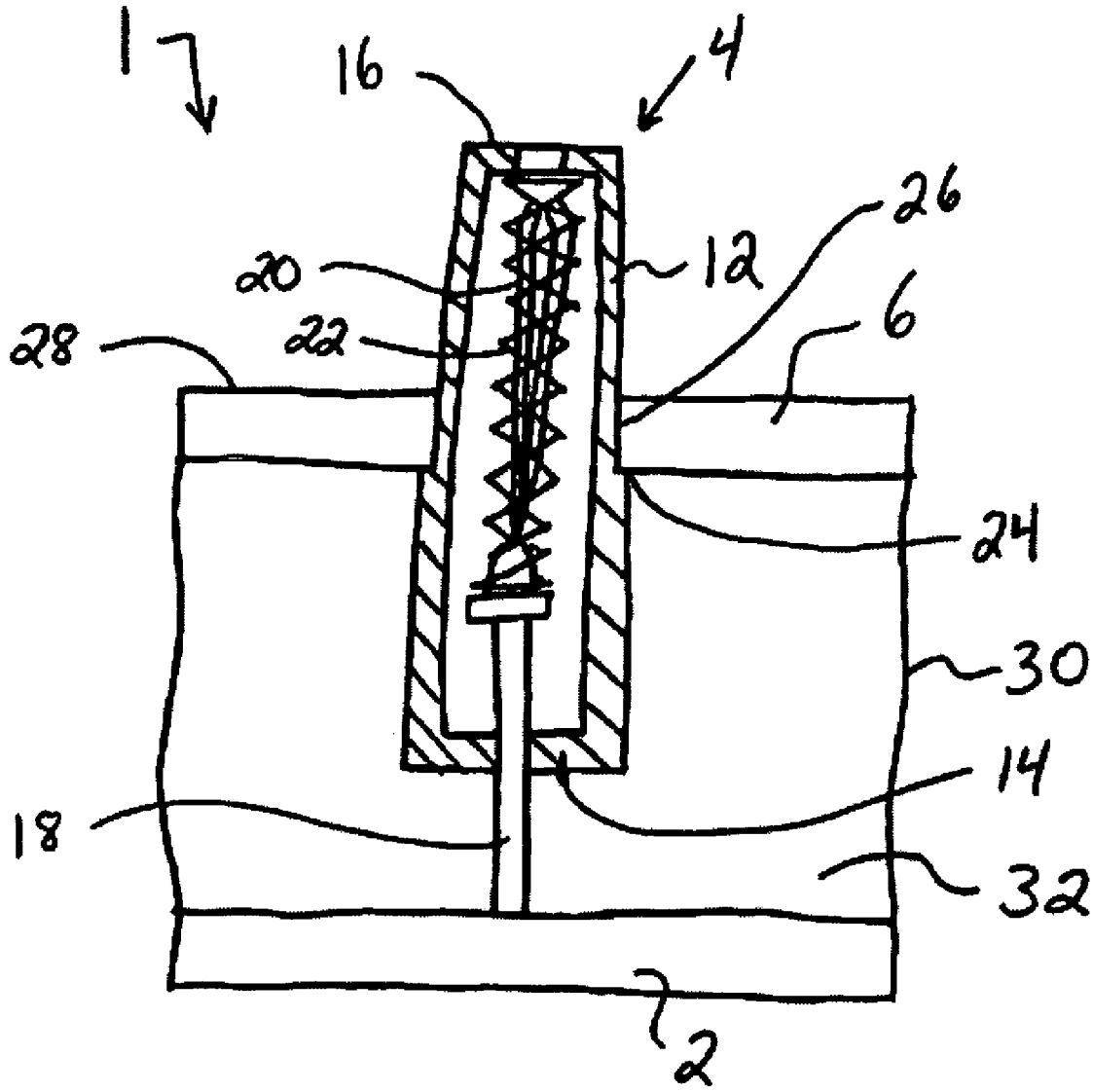
FIG. 1 is a partial cross-sectional view of a display structure in accordance with a first embodiment of the present invention.
Figure 2:
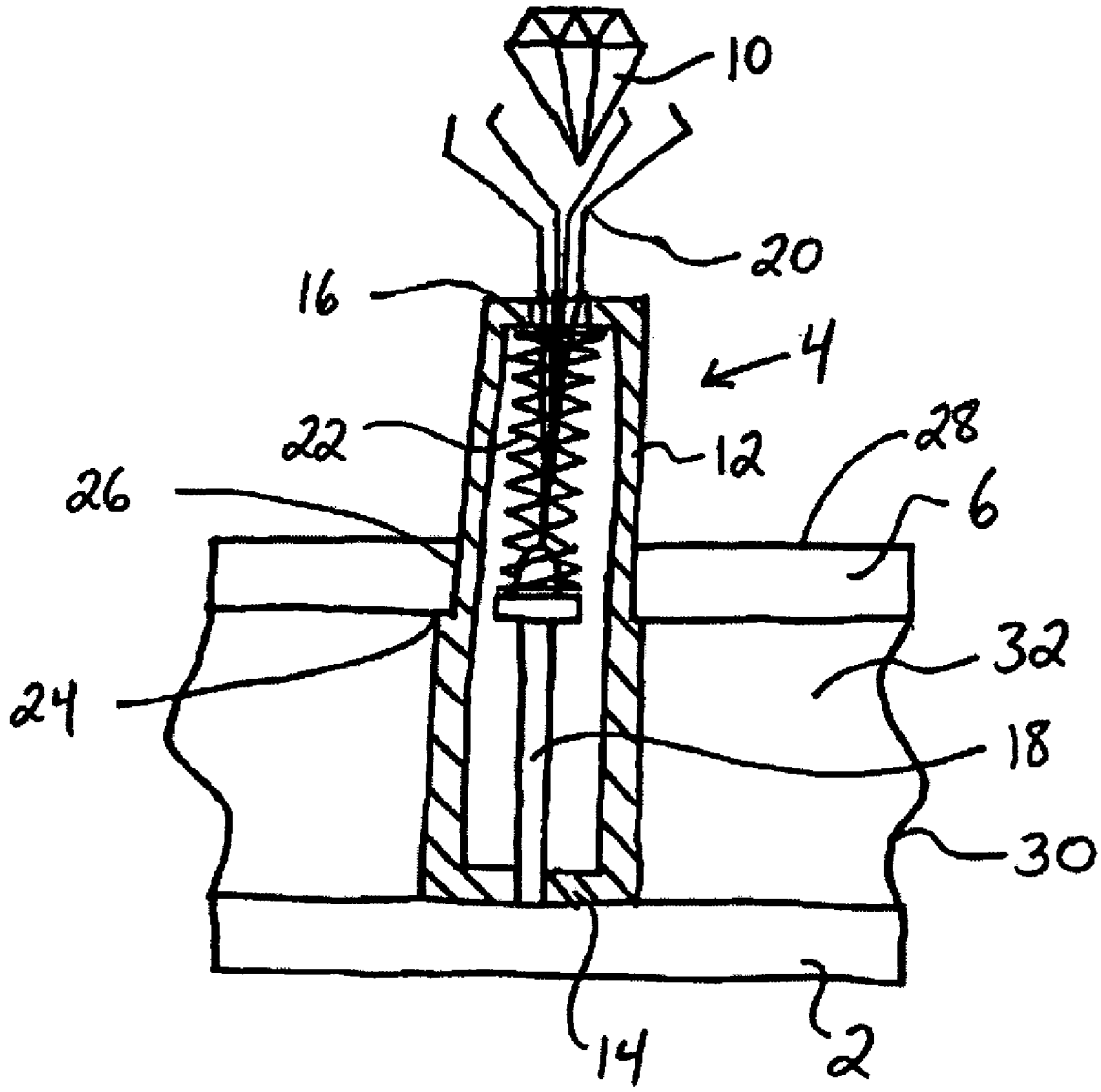
FIG. 2 is a partial cross-sectional view of a display structure in accordance with the first embodiment of the present invention wherein the gripping member is in a position for receipt of an article to be displayed.
Figure 3:
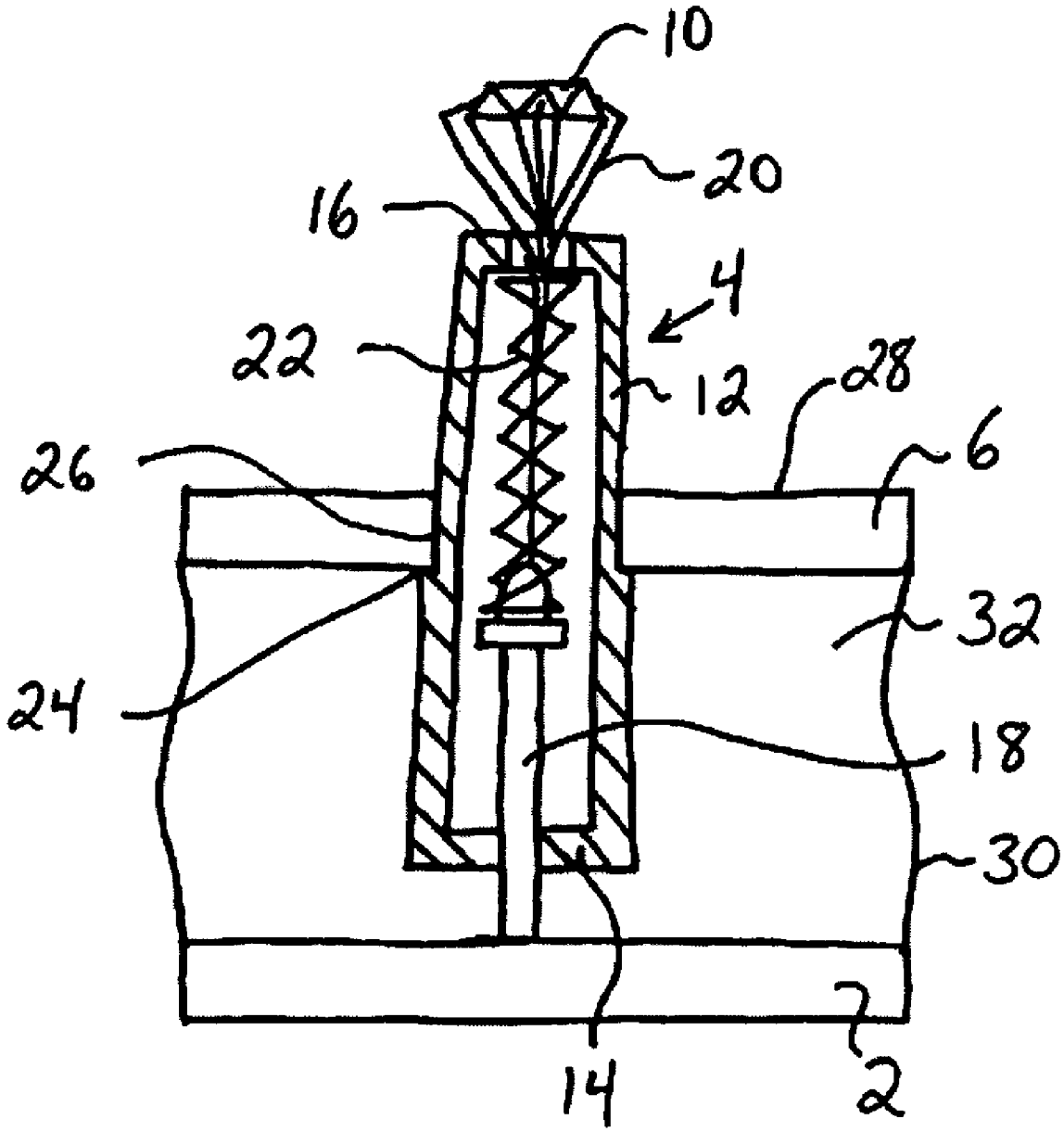
FIG. 3 is a partial cross-sectional view of a display structure in accordance with the first embodiment of the present invention wherein an article is present within the gripping member.

Referring now to the drawings, wherein like reference numerals represent like elements, FIGS. 1-3 show a first embodiment of a display structure 1 of the present invention. The display structure 1 includes a base 2, a gripping member 4 extending from the base 2 and adapted to clasp an article 10, and a platform member 6 positioned above the base 2 and coupled to the gripping member 4. The base 2 is preferably designed to stand on a surface. The article 10 clasped within the gripping member 4 is preferably a precious stone, a semi-precious stone, a coin, or the like.

The gripping member 4 preferably comprises a shell 12 having a first end 14 and a second end 16, a shaft 18 extending from the base 2, a set of gripping prongs 20 attached to the shaft 12, and a spring 22 biasing the shaft 18 and the shell 12 for movement relative to each other. The shaft 18 is positioned within the shell 12 and extends outward from the first end 14 thereof. The set of gripping prongs 20 preferably includes at least two prongs, most preferably four prongs. Therefore, although the set of gripping prongs shown in FIGS. 1-3 include four prongs, the present invention is not to be limited to this number. It will be readily apparent to one of skill in the art from the detailed description that the number and design of the set of gripping prongs can be altered depending upon the properties of the article intended to be clasped and displayed. For instance, prongs of different shape (flat, clips) can be used to display stamps, coins, etc.

As shown in FIG. 1, the platform member 6 is coupled to the shell 12 of the gripping member 4. As shown in FIG. 2, Movement of the platform member 6 relative to the base 2 moves the gripping member 4 into a position for receipt and clasping of the article 10. As shown in FIG. 3, once the article 10 is placed into gripping member 4, the platform member 6 is released allowing gripping member 4 to clasp and hold the article 10 for display.

As shown in FIGS. 1-3, the platform member 6 is preferably coupled to the shell 12 of the gripping member 4 by providing the shell 12 with a recessed portion 24 and providing the platform member 6 with an aperture 26 through which the shell 12 of the gripping member 4 is inserted such that the platform member 6 sits upon the recessed portion 24. With the aforementioned arrangement, movement of the platform member 6 toward the base 2 to place the gripping member 4 into a position for receipt and clasping of the article 10 causes the shell 12 of the gripping member 4 to move with the platform member 6 by interaction of the platform member 6 and the recessed portion 24 of the shell 12.

Although it is preferred that the platform member 6 be coupled to the shell 12 of the gripping member 4 as described above, it will be readily apparent, and within the scope of the present invention, that the platform member 6 be attached to the shell 12 of the gripping member 4 by any other means, such as glue, tape, epoxy, or the like.

As shown in FIG. 1, when the gripping member 4 does not have an article clasped within the gripping prongs 20, the gripping prongs 20 are preferably positioned within the shell 12. Movement of the platform member 6 to a position such as that shown in FIG. 2 compresses the spring 22 and extends the set of gripping prongs 20 from the second end 16 of the shell 12 for receipt and clasping of the article 10. Gripping prongs 20 are preferably constructed such that they are biased into an open position/arrangement allowing for the easy placement of the article 10 within the gripping prongs 20. Once platform member 6 is released, gripping prongs 20 partially re-enter shell 12 and the ends of the prongs clasp and hold the article 10 for display as shown in FIG. 3.

Movement of the platform member 6 is preferably accomplished by the application of pressure to an upper surface 28 of the platform member 6 toward the base 2, thereby moving the platform member 6 relative to the base 2. The present invention, however, may be designed such that the base 2 is moved relative to the platform member 6.

When the article 10 is positioned within the set of gripping prongs 20, and the pressure on the upper surface 28 of the platform member 6 is removed, the spring 22 biases the shell 12 into the position shown in FIG. 3 such that the article 10 is securely clasped in the gripping prongs 20. In this position, the article 10 is ready for display and viewing.

To remove the article 10 from the gripping prongs 4, pressure is applied to upper surface 28 of the platform member 6 toward the base 2 so as to compresses the spring 22 and separate the set of gripping prongs 20 from the article 10 and thereby place the display structure 1 in a position similar to that shown in FIG. 2. In this position, the article 10 can be removed and a different article can be placed in the gripping member 4 for display and viewing.

In order to conceal the working components of the display structure 1, it is preferred, as shown in FIGS. 1-3, that a fabric or other pliable material 30 extend between the platform member 6 and the base 2 so as to form an enclosure 32. The pliable material 30 can be glued or otherwise affixed to the platform member 6 and the base 2.

With the above arrangement, an article can be easily placed in the set of gripping prongs 20 of the gripping member 4, and the base 2 of the display structure 1 can be supported on a surface for easy display and viewing of the article 10.

FIGS. 4-7 show a second embodiment of the present invention adapted to form a display case 40. In the second embodiment, the pliable material is replaced with a housing 42 within which the display structure 1 of FIGS. 1-3 is arranged to form the display case 40. In the description of FIGS. 4-7, the detailed description of the component parts of the display structure 1 is omitted and reference is made to the description relating to FIGS. 1-3, as the operation and parts thereof are preferably substantially the same.

Figure 4:
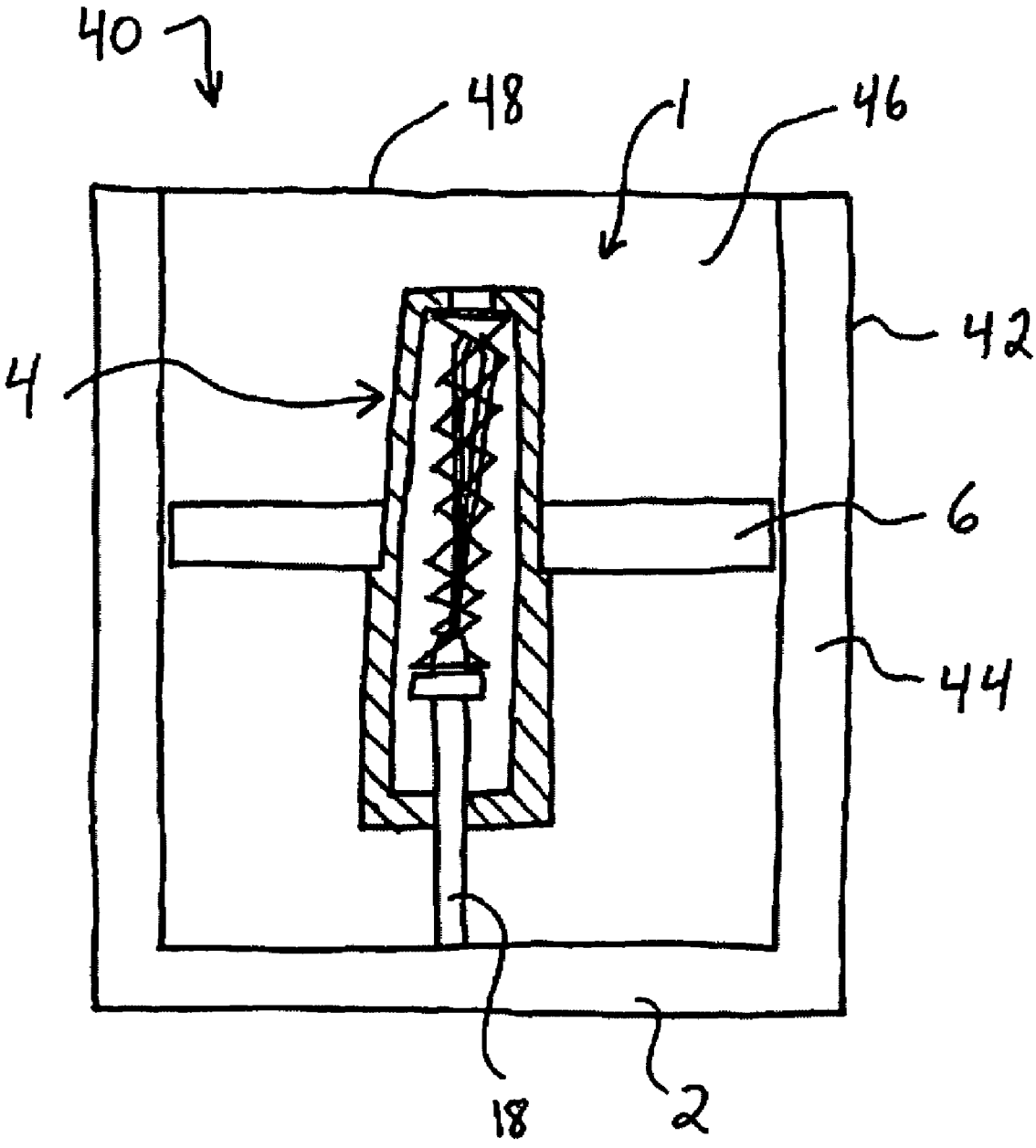
FIG. 4 is a partial cross-sectional view of a display structure in accordance with a second embodiment of the present invention.

As shown in FIG. 4, the housing 42 includes a peripheral wall 44 extending upward from the base 2 so as to define a cavity 46 having an open end 48. The gripping member 4 is located within the cavity 46 and extends from the base 2 toward the open end 48 of the cavity 46. The platform member 6 is located within the cavity 46, positioned above the base 2, and coupled to the gripping member 4. As described above with reference to FIGS. 1-3, the gripping member 4 is movable into a position for receipt and clasping of an article 10 by movement of the platform member 6 toward the base 2.

Figure 5:
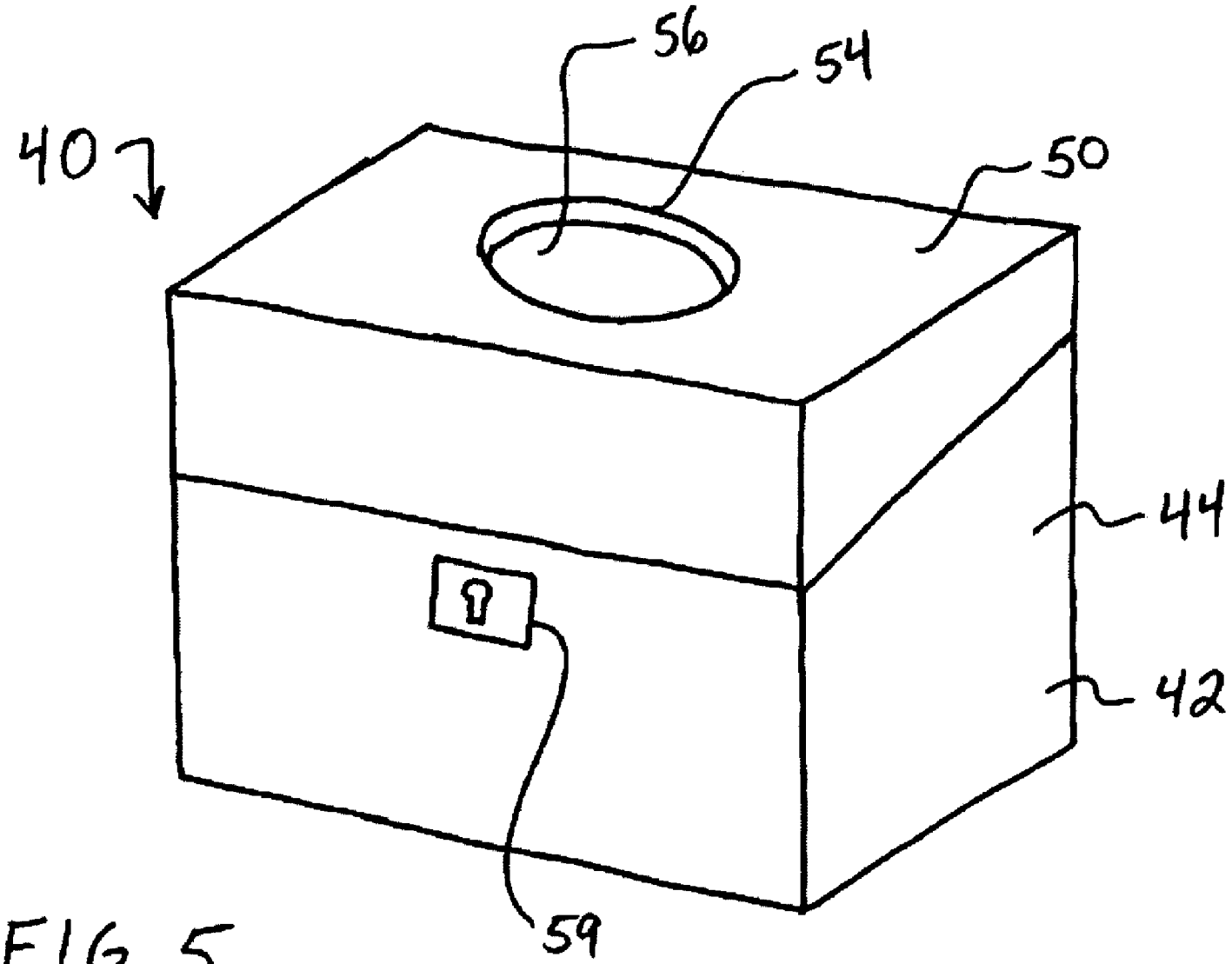
FIG. 5 is a front perspective view of a display structure in accordance with the second embodiment of the present invention.
Figure 6:
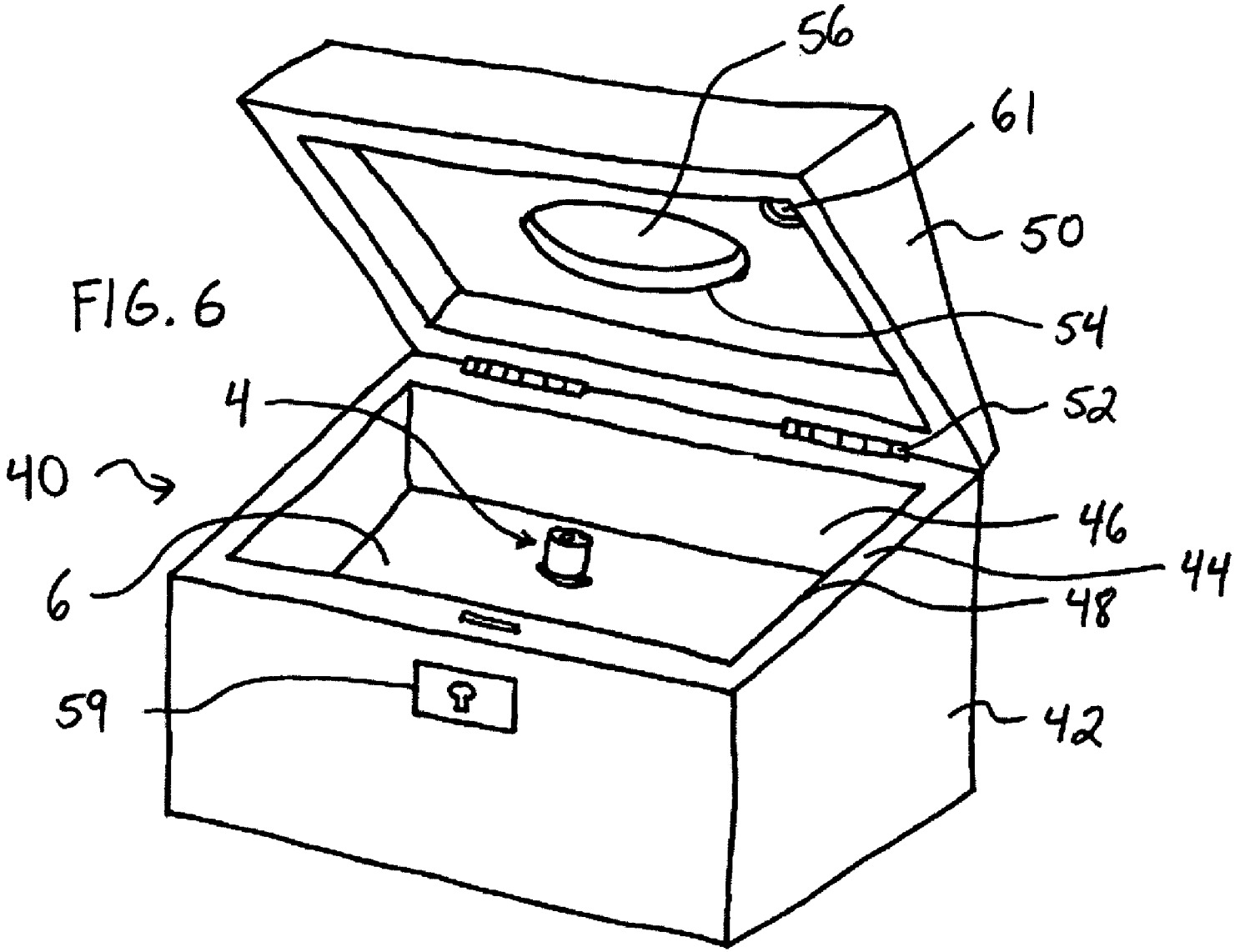
FIG. 6 is a front perspective view of the display structure of FIG. 5 with the cover in an open position.
Figure 7:
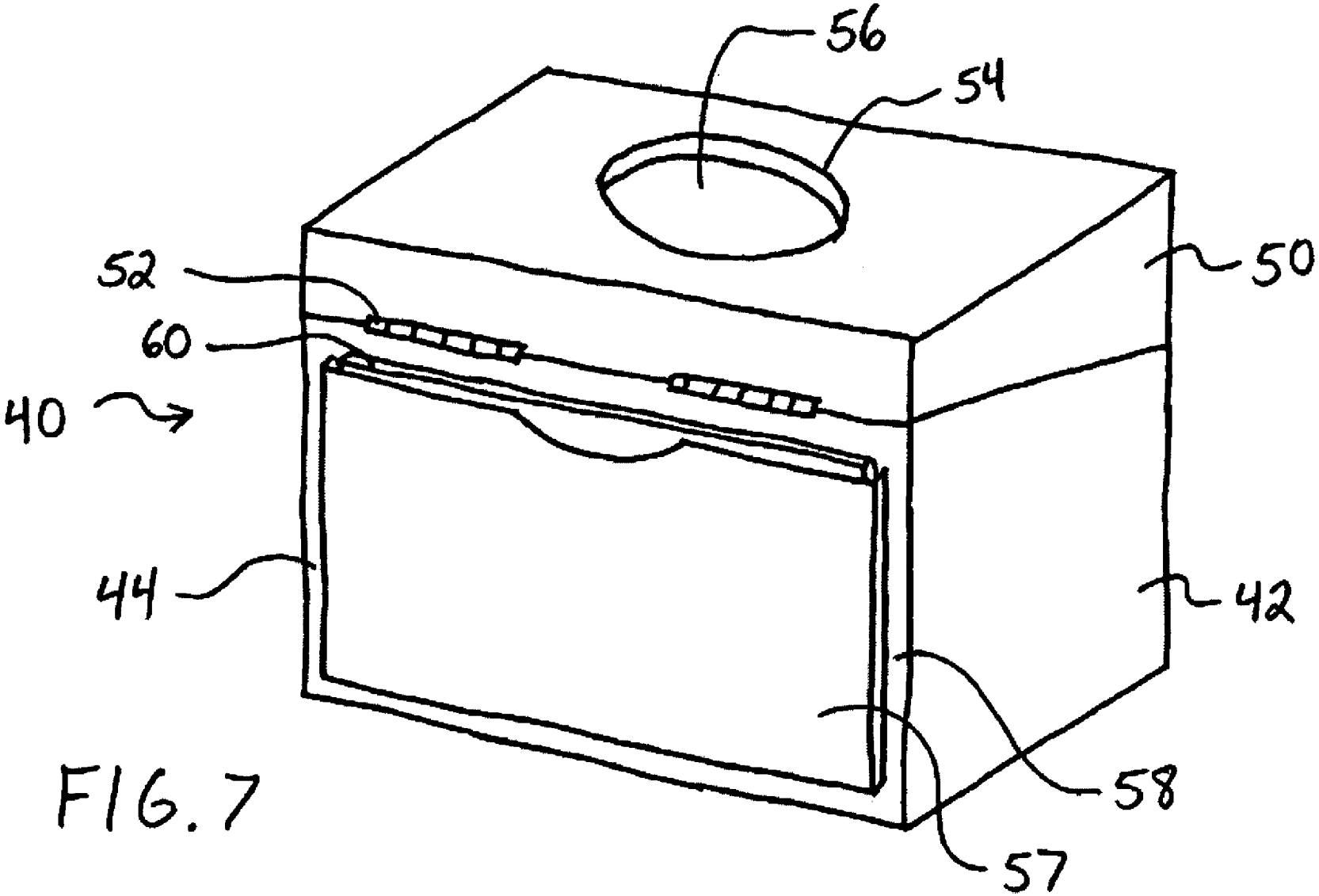
FIG. 7 is a rear perspective view of the display structure of FIG. 5.

In a preferred embodiment such as that shown in FIGS. 5-7, a cover 50 is pivotally attached to the housing 42 and covers the open end 48 of the cavity 46. Preferably, as shown in FIG. 6, the cover 50 is attached to the housing by at least one hinge 52 arranged horizontally, which allows the cover 50 to be pivoted open similar to a clam-shell. Other types of hinges such as a vertically-arranged hinge which connects the cover to the housing at a single pivot point and allows the cover to swing open about that pivot point can equally be used.

The cover 50 can also connect to the housing 42 by many different methods known in the art. For example, the cover 50 may be configured to slide over the housing 42 (similar to the top of a shoe box).

In the preferred embodiment, the cover 50 includes a portal 54 that provides visual access to the cavity 46 of the display case 40. In the most preferred embodiment, the portal 54 is fitted with a lens 56 for magnifying the contents of the cavity 46 of the display case 40. The lens can provide any desired degree of magnification, 10× being the most preferred, and can be of any shape or size. In addition, the lens can have no magnification (i.e., glass), or the portal can simply be an open hole of any shape or size.

Although only a single, round portal 54 is shown in the top portion of the cover 50, it will be readily apparent that more than one portal can be provided in the cover 50, and that the portal 54 can be located on a different portion of the cover 50, such as in a side portion. The portal 54 can also be provided in the sides of the display case 40 in addition to, or instead of, in the cover 50. Further, the portal or portals can be made into any desired shape, and are not limited to the round shape shown.

In addition to the cover 50 and the portal 54, the display case 40 is also preferably provided with a pocket 57 attached to the an external surface 58 of the peripheral wall 44 of the housing 42 as shown in FIG. 7. The pocket 57 is dimensioned to hold a card 60 containing information about the article contained in the display case 40 or a greeting type card. For example, if the article is a precious stone such as a diamond, the information card can be a copy of the Gemological Institute of America's GIA Diamond Grading Report, or the like.

When a cover 50 is provided to cover the open end 48 of the cavity 46, the display case 40 can include a lock 59 to secure the cover 50 to the housing 42 as shown in FIGS. 5 and 6. Further, as shown in FIG. 6, the display case 40 can also be provided with a light source 61 to illuminate the cavity 46. The light source 61 can be any type of light source such as an incandescent bulb, an LED, or the like. Although FIG. 6 shows the light source 61 attached to the cover 50, it is possible that the light source can be located anywhere within the display case 40.

Although FIGS. 4-7 show the housing 42 of the display case 40 to be rectangular, the present invention is not limited to this shape. Accordingly, the housing of the display case may be formed in other shapes, such as circular, square, heart-shaped, triangular, or the like. With the different shapes, it is preferred that the perimeter of the platform member be dimensioned to fit within the shape of the housing and thereby conceal the component parts of the gripping member.

In addition, the material of the housing may be formed from many different materials, including, but not limited to, wood, leather, metal, glass, plastic or any combination thereof.

With the above arrangement, a decorative display case can be provided which allows magnified viewing of an article without the need for a potential buyer to hold the article in one hand and the magnification lens in the other. Thus, the display case of the present invention provides a structure for the easy display and viewing of an article.

Although FIGS. 1-7 show only one gripping member 4, the present invention can be easily modified to have a plurality of gripping members incorporated into the display structure or display case. When a plurality of gripping members are provided, either a single platform member can be used to simultaneously operate the plurality of gripping members, each gripping member of the plurality of platform members can be provided with a corresponding platform member that is separately operable from the other platform members, or different platform members can be used to operate separate sub-groups of two or more gripping members of the plurality of gripping members. Accordingly, the display structure described hereinabove can be modified to display multiple articles as opposed to only a single article.

Even though the present invention has been described in relation to a display structure for a gemstone or other small valuable article, it will be readily apparent that the relative dimensions of the component parts of the display structure can be altered for use with other larger valuable articles, such as, jewelry and sports memorabilia including balls, bats, helmets, etc., to name a few. Accordingly, although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A display structure comprising:

a base having a first surface;

a gripping member extending from the base and movable into a position for receipt and clasping of an article, the gripping member comprising:

a shell having a first end and a second end;

a shaft positioned within and extending outward from the first end of the shell;

a set of gripping prongs attached to the shaft and disposed within the shell in a first position, and disposed outside of the shell when in the position for receipt and clasping of the article; and a spring biasing the shaft and the shell for movement relative to each other; and a platform member having a second surface positioned above the base so that the second surface is opposite the first surface and defines an area therebetween, the platform member coupled to the gripping member such that downward movement of the platform member towards the base moves the gripping member into the position for receipt and clasping of the article.

2. The display structure according to claim 1, wherein movement of the platform member compresses the spring and extends the set of gripping prongs from the second end of the shell for receipt and clasping of the article.

3. The display structure according to claim 1, wherein the shell of the gripping member is attached to the platform member.

4. The display structure according to claim 1, wherein the shaft of the gripping member is attached to the base.

5. The display structure according to claim 1, wherein the set of gripping prongs includes at least two prongs.

6. The display structure according to claim 1, wherein the article is one of a precious stone, a semi-precious stone, and a coin.

7. The display structure according to claim 1, further comprising a pliable material extending between the platform member and the base.

8. The display structure according to claim 7, wherein the pliable material extends between the platform member and the base to form an enclosure.

9. The display structure according to claim 7, wherein the pliable material is a fabric.

10. A display structure comprising:

a base having a first surface;

at least one gripping member extending from the base and movable into a position for receipt and clasping of an article, each gripping member comprising:

a shell having a first end and a second end;

a shaft positioned within and extending outward from the first end of the shell;

a set of gripping prongs attached to the shaft and disposed within the shell in a first position, and disposed outside of the shell when in the position for receipt and clasping of the article; and a spring biasing the shaft and the shell for movement relative to each other; and at least one platform member having a second surface positioned above the base so that the second surface is opposite the first surface and defines an area therebetween, the at least one platform member coupled to the at least one gripping member such that downward movement of the at least one platform member towards the base moves the at least one gripping member into the position for receipt and clasping of the article.

11. The display structure according to claim 10, further comprising a pliable material extending between the at least one platform member and the base.

12. The display structure according to claim 11, wherein the pliable material extends between the at least one platform member and the base to form an enclosure.

13. The display structure according to claim 11, wherein the pliable material is a fabric.

14. A display comprising:

a housing having a base and a peripheral wall extending upward from the base to define a cavity having an open end; and a gripping member located within the cavity, the gripping member including:

a shell having a first end and a second end;

a shaft extending from the first end of the shell;

a set of gripping prongs coupled to the shaft and adapted to clasp an articles, the set of gripping prongs being disposed within the shell in a first position, and disposed outside of the shell in a second position when clasping the article; and a spring biasing the shaft and the shell for movement relative to each another.

15. The display structure according to claim 14, wherein movement of the shaft relative to the shell compresses the spring and positions the set of gripping prongs for clasping of the article.

16. The display structure according to claim 14, wherein the shell of the gripping member is attached to a platform member.

17. The display structure according to claim 14, wherein the shaft of the gripping member is attached to the base.

18. The display structure according to claim 14, wherein the set of gripping prongs includes at least two prongs.

19. The display structure according to claim 14, wherein the article is one of a precious stone, a semi-precious stone, and a coin.

* * * * *